US011814143B2

(12) United States Patent
Smith

(10) Patent No.: US 11,814,143 B2
(45) Date of Patent: Nov. 14, 2023

(54) MARINE NAVIGATIONAL AID APPARATUS AND METHOD

(71) Applicant: Sidney N. Smith, Coeur d'Alene, ID (US)

(72) Inventor: Sidney N. Smith, Coeur d'Alene, ID (US)

(73) Assignee: Sidney N. Smith, Coeur d'Alene, ID (US)

( * ) Notice: Subject to any disclaimer, the term of this patent is extended or adjusted under 35 U.S.C. 154(b) by 5 days.

(21) Appl. No.: 17/526,964

(22) Filed: Nov. 15, 2021

(65) Prior Publication Data

US 2022/0073171 A1 Mar. 10, 2022

Related U.S. Application Data

(63) Continuation of application No. 16/670,271, filed on Oct. 31, 2019, now abandoned.

(51) Int. Cl.

| | |
|---|---|
| ***B63B 49/00*** | (2006.01) |
| ***E02D 5/60*** | (2006.01) |
| ***E02D 5/22*** | (2006.01) |

(52) U.S. Cl.

CPC ..... *B63B 49/00* (2013.01); *E02D 5/223* (2013.01); *E02D 5/60* (2013.01)

(58) Field of Classification Search

CPC ..... B63B 49/00; E02D 5/223; E02D 5/60; E02D 5/64

See application file for complete search history.

(56) References Cited

U.S. PATENT DOCUMENTS

| | | | |
|---|---|---|---|
| 4,713,129 | A | 12/1987 | Inhofe, Jr. |
| 5,018,471 | A | 5/1991 | Stevens |
| 5,516,236 | A | 5/1996 | Williams |
| 5,518,342 | A | 5/1996 | Wright |
| 6,019,549 | A | 2/2000 | Blair |
| 6,347,911 | B1 | 2/2002 | Blair |
| 8,403,598 | B2 | 3/2013 | Thomas |
| 9,328,476 | B1 | 5/2016 | Langham |
| 2004/0240943 | A1 | 12/2004 | Brensinger |
| 2006/0088386 | A1 | 4/2006 | Ellis |
| 2010/0021240 | A1 | 1/2010 | Castrogiovanni |
| 2021/0129950 | A1 | 5/2021 | Smith |

FOREIGN PATENT DOCUMENTS

| | | |
|---|---|---|
| WO | 9204504 | 3/1992 |

OTHER PUBLICATIONS

Fender Systems; Dalbenfender Pile-Mooring-Fender; PF 40/80; seaEQ.com; Known of as early as ****.

Five Star Products, Inc., PileForm W Retrowrap by Corrosion Control International; @ 2015.

Office Action dated May 14, 2021; U.S. Appl. No. 16/670,271; 13 Pages.

*Primary Examiner* — Kyle Armstrong

(74) *Attorney, Agent, or Firm* — Fitch, Even, Tabin & Flannery, LLP

(57) ABSTRACT

A marine navigational aid for use with a piling. This marine navigational aid comprises a flexible wrap, at least one affixment mechanism coupled to the flexible wrap, and a plurality of alphanumeric characters disposed on an exterior side of the flexible wrap.

18 Claims, 3 Drawing Sheets

MARINE NAVIGATIONAL AID APPARATUS AND METHOD

RELATED APPLICATION(S)

This is a continuation of U.S. patent application Ser. No. 16/670,271, Filed Oct. 13, 2019, entitled MARINE NAVIGATIONAL AID APPARATUS AND METHOD, which is incorporated by reference in its entirety herein.

BACKGROUND

Technical Field

These teachings relate generally to marine navigational aids.

Marine navigational aids are known in the art. Generally speaking, a marine navigational aid provides helpful information to mariners to help the mariner avoid dangers, to safely traverse a particular body of water, to locate a particular desired service, to be informed of local laws and regulations pertaining to boating, and so forth.

Accordingly, marine navigational aids can contribute significantly to safe and convenient boating. Unfortunately, many marine navigational aids are relatively expensive to manufacture and/or to install or maintain. As a result, fewer such aids may be deployed in a given body of water than might otherwise be useful or helpful.

BRIEF DESCRIPTION OF THE DRAWINGS

The above needs are at least partially met through provision of the marine navigational aid apparatus and method described in the following detailed description, particularly when studied in conjunction with the drawings, wherein.

Figure 1:
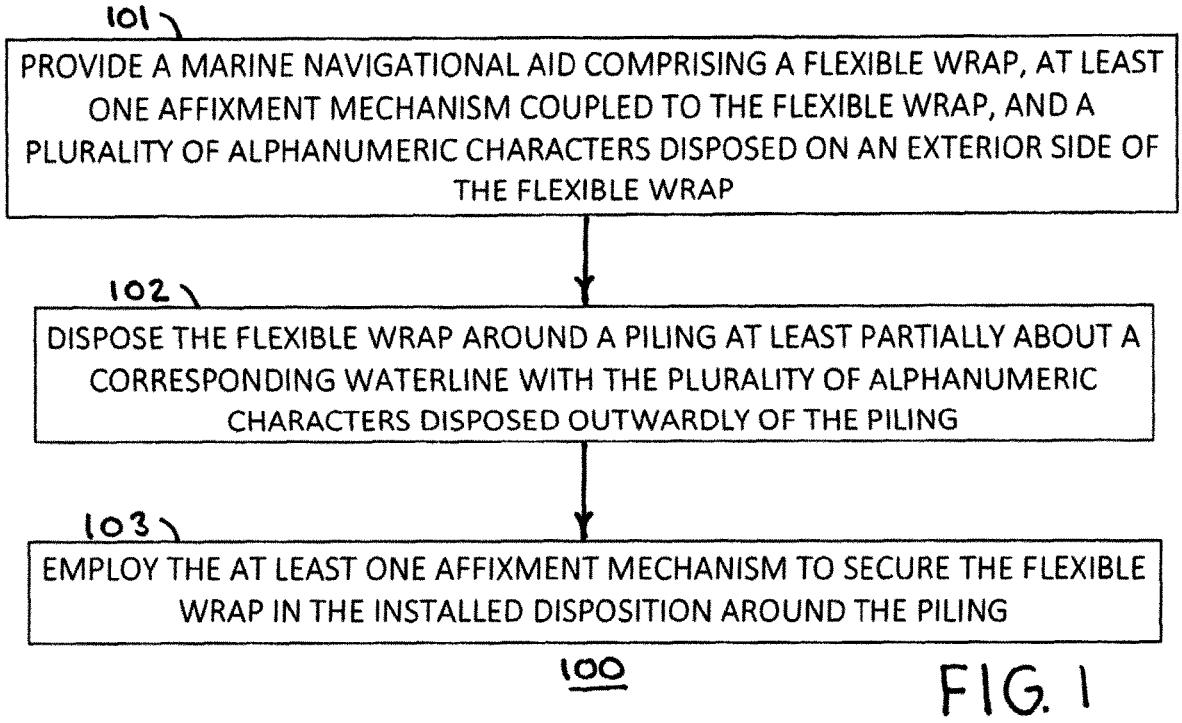
FIG. 1 comprises a flow diagram as configured in accordance with various embodiments of these teachings.

Elements in the figures are illustrated for simplicity and clarity and have not necessarily been drawn to scale unless indicated otherwise. For example, the dimensions and/or relative positioning of some of the elements in the figures may be exaggerated relative to other elements to help to improve understanding of various embodiments of the present teachings. Also, common but well-understood elements that are useful or necessary in a commercially feasible embodiment are often not depicted in order to facilitate a less obstructed view of these various embodiments of the present teachings. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein. The word "or" when used herein shall be interpreted as having a disjunctive construction rather than a conjunctive construction unless otherwise specifically indicated.

DETAILED DESCRIPTION

Generally speaking, these various embodiments provide a marine navigational aid for use with a piling. This marine navigational aid comprises a flexible wrap, at least one affixment mechanism coupled to the flexible wrap, and a plurality of alphanumeric characters disposed on an exterior side of the flexible wrap.

The flexible wrap is configured to be substantially conformally wrapped around the circumference of the piling though without forming a waterproof seal. By one approach this flexible wrap is at least substantially comprised of a non-padded wrap formed of a waterproof material. By one approach the flexible wrap comprises a substantially non-resilient flexible wrap and may further comprise an acrylic-based fiber.

The aforementioned affixment mechanism is configured to affix the flexible wrap in an installed disposition around the piling at least partly above a corresponding water line such that at least part of the flexible wrap is ordinarily visible to an observing mariner using ordinary vision. These teachings are highly practical in use and will accommodate a variety of different affixment mechanisms including, but not limited to, ties, snaps, and hooks-and-loops fasteners.

The aforementioned plurality of alphanumeric characters are disposed on an exterior side of the flexible wrap when the flexible wrap is in the aforementioned installed disposition around the piling. These alphanumeric characters impart marine navigational aid content to the observing mariner. If desired, non-alphanumeric characters can be additionally provided to suit the needs and/or opportunities presented by a given application setting.

So configured, long-lasting and easily-deployed marine navigational aids are realized. Relatively speaking, these marine navigational aids represent a minimal economic cost in that the aids are relatively inexpensive to manufacture and procure, to install, and to maintain. Such features, in turn, make it reasonable to install as many such marine navigational aids as may be useful in a given application setting to thereby help ensure safe and convenient motor boating.

These and other benefits may become clearer upon making a thorough review and study of the following detailed description. Referring now to the drawings, and in particular to FIG. 1, an illustrative process 100 that is compatible with many of these teachings will now be presented.

Figure 2:
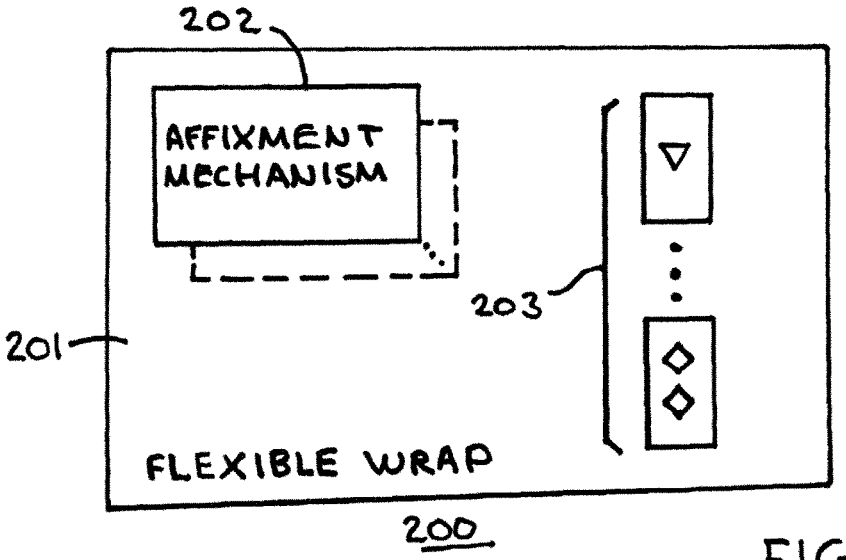
FIG. 2 comprises a block diagram as configured in accordance with various embodiments of these teachings.

With reference to FIG. 1, and referring as well to FIG. 2, this process 100 presents an approach to providing a marine navigational aid 200 that is readily configured for compatible use with a corresponding piling. As used herein, a "piling" will be understood to comprise a cylinder that is vertically embedded or otherwise anchored in/to the ground beneath a body of water such as an ocean, lake, pond, river, or other waterway and having an upper portion that vertically extends above that body of water. Such pilings are often formed of wood but can be formed of other materials as well. In many cases, and especially when the piling is formed of wood, the outer surface of the piling can be irregular.

At block 101, this process 100 provides a marine navigational aid 200 that comprises a flexible wrap 201. This flexible wrap 201 is configured to be substantially conformally wrapped around a circumference of the aforementioned piling without forming a waterproof seal.

In this context, the expression "substantially conformally wrapped" will be understood to mean that at least 50 percent of the flexible wrap 201 is in contact with the piling when in an installed disposition around the piling. In many application settings a greater percentage of the flexible wrap 201 may be in physical contact with the piling, such as at least 60 percent of the flexible wrap 201, at least 70 percent of the flexible wrap 201, at least 80 percent of the flexible wrap 201, or even at least 90 percent of the flexible wrap 201. Generally speaking, there is enough of the flexible wrap 201 in physical contact with the piling to hold the flexible wrap 201 in place on the piling via friction during ordinary expected use (wherein the expected use includes contact with moving water and floating objects such as boats or driftwood as well as environmental factors such as wind and various forms of precipitation).

Although the flexible wrap 201 will be sufficiently tight on the piling to hold the flexible wrap 201 in its installed position, the flexible wrap 201 is not designed to form a waterproof seal between itself and the piling. In particular, it is expected that water can and will make its way between at least parts of the flexible wrap 201 and the piling (especially given the irregular surface features of a typical wooden piling). This lack of a waterproof seal is acceptable because this flexible wrap 201 is neither designed nor intended to protect the piling from moisture or water-borne organisms.

By one approach this flexible wrap 201 comprises a substantially non-resilient flexible wrap. If desired, the flexible wrap 201 may exhibit a 100 percent dead-fold behavior (meaning that the material, when folded, does not spontaneously unfold at all). The expression "substantially non-resilient" will be understood to refer to a range extending from 50 percent dead-fold behavior to 100 percent debt-full behavior.

Generally speaking, the flexible wrap 201 comprises a single ply of environmentally-resistant fabric such as a fabric formed of an acrylic-based fiber. (It will be understood that the expression "environmentally-resistant" refers to being resistant to wear and tear ordinarily associated with exposure to various outdoor factors including specifically water (including both fresh and saltwater) and sunlight.) Marine-grade fabrics offered under the brand name Sunbrella by Glen Raven, Inc. are one useful example in these regards.

One or more additional plies of such a fabric may be utilized if desired. As noted above, however, the flexible wrap 201 comprises a non-padded wrap and therefore additional layers are typically unnecessary. Generally speaking, there is no need for the marine navigational aid 200 to be buoyant. Accordingly, the fabric wrap 201 can itself be non-buoyant.

Figure 3:
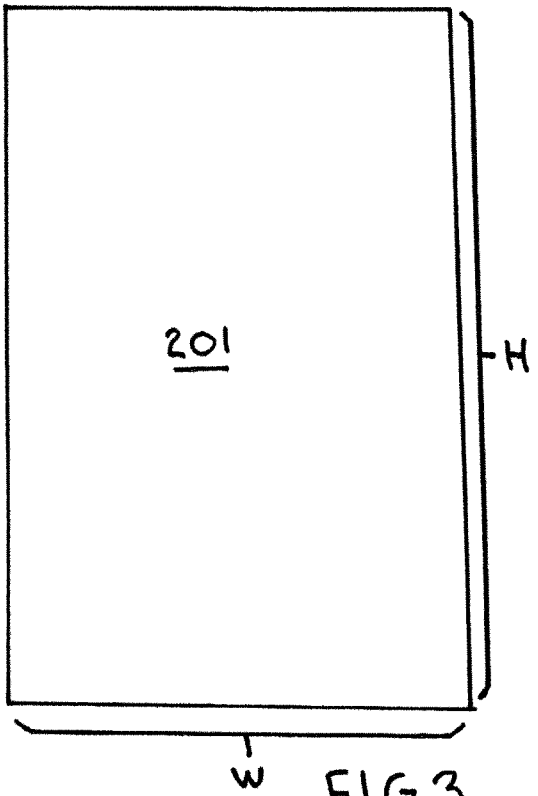
FIG. 3 comprises a top plan view as configured in accordance with various embodiments of these teachings.

Referring momentarily to FIG. 3, in a typical application setting the flexible wrap 201 will have a rectangular shape when fully opened and accordingly have a corresponding width W and height H. The width will ordinarily be selected to accommodate a particular sized piling or a piling within a particular range of size. For example, for a piling having a 6¼ inch diameter, the width may be 20 inches. Generally speaking, the width will be sufficient to permit the flexible wrap 201 to snugly overlap upon itself when in an installed disposition around a piling. The height, in turn, can be sized to accommodate the alphanumeric characters described further below. Generally speaking, for many application settings and for many intended navigational messages, the height may be at least 18 inches.

Figure 4:
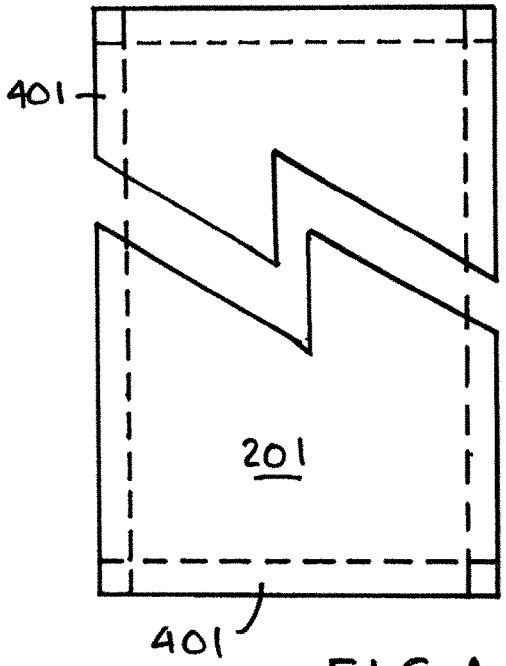
FIG. 4 comprises a top plan view as configured in accordance with various embodiments of these teachings.

Referring momentarily to FIG. 4, by one approach the flexible wrap 201 includes a perimeter hem 401 formed at one or more of the edges thereof. As illustrated, all four edges of the flexible wrap 201 have such a perimeter hem 401. The perimeter hem 401 can have a width of choice such as 1 inch, 1.5 inches, 2 inches, and so forth. This perimeter hem 401 can be formed using a single stitch, a double stitch (which may be preferred for many application settings), a triple stitch, and so forth as desired. When using multiple stitches, each stitch line may be identical to the other stitch lines or one or more of the stitch lines may vary in some regard as desired.

For many application settings it will be preferable that the exterior side of the flexible wrap 201 (i.e., the side of the flexible wrap 201 that faces outwardly when the flexible wrap 201 is in an installed disposition on a piling) be at least largely a single color such as white, yellow, or red. This is both to help ensure that the marine navigational aid 200 is readily discernible during use and also to present a uniform background for the alphanumeric characters described below that does not conflict with or otherwise inhibit visually discerning those characters.

Referring again to FIGS. 1 and 2, at block 101 the provided marine navigational aid 200 also comprises at least one affixment mechanism 202. The affixment mechanism 202 couples to the flexible wrap 201 and is configured to affix the flexible wrap 201 in an installed disposition around a piling at least partly above a corresponding water line for that piling such that at least part of the flexible wrap 201 is ordinarily visible to an observing mariner using ordinary vision.

These teachings will accommodate a variety of affixment mechanisms including, if desired, simultaneous use of an assortment of different affixment mechanisms. Generally speaking, these affixment mechanisms serve to secure one part of the flexible wrap 201 to another part of the flexible wrap 201 and therefore do not serve to directly connect the flexible wrap 201 to the piling. Examples of suitable affixment mechanisms include, but are not limited to, snaps, ties, zippers, and hooks-and-loops fasteners. The affixment mechanism 202 should be generally resistant to the operationally degrading effects of the intended marine application setting.

Figure 5:
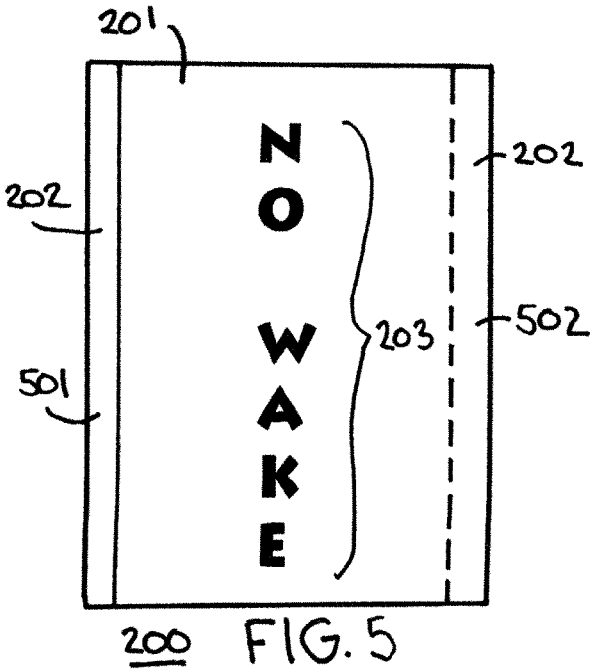
FIG. 5 comprises a top plan view as configured in accordance with various embodiments of these teachings.
Figure 6:
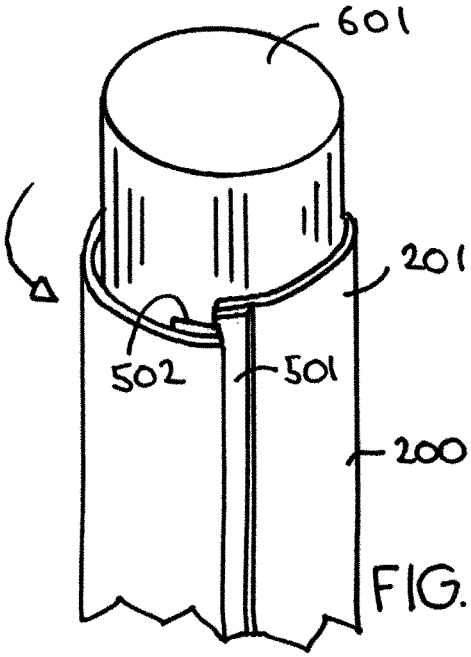
FIG. 6 comprises a perspective view as configured in accordance with various embodiments of these teachings.

FIGS. 5 and 6 provide one illustrative example in these regards. In this example the attachment mechanism 202 comprises a strip of loops 501 and a strip of hooks 502 secured to opposing sides of the flexible wrap 201. In this example each strip runs the full height of the flexible wrap 201. If desired, intermittent patches of such material could be substituted. These strips can be connected to the flexible wrap 201 using any suitable affixment mechanism including adhesives, stitching, and so forth. So configured, and as shown in FIG. 6, the flexible wrap can be snugly overlapped upon itself when in the installed disposition around a piling 601 and then maintained in this disposition by the adhering interaction between the aforementioned hooks and loops.

Referring again to block 101 of FIG. 1 and FIG. 2, the provided marine navigational aid 200 also comprises a plurality of alphanumeric characters 203 that are disposed on an exterior side of the flexible wrap 201 when the flexible wrap 201 is in the installed disposition around a piling. These alphanumeric characters 203 impart marine navigational aid content to an observing mariner. (The alphanumeric characters 203 are represented schematically in FIG. 2 by a triangle and a double diamond icons.) Referring to FIG. 5, in this illustrative example the alphanumeric characters 203 are the letters for the two words "no wake." Other possibly useful examples in these regards might include, but are not limited to, marina, shallow, rocks, private, public, restrooms, fuel, and lock, to note but a few.

In a typical application setting the plurality of alphanumeric characters 203 are vertically disposed on the flexible wrap 201 and hence are parallel to the edges that represent the height of the flexible wrap 201. By one approach these characters are formed of a same material as the flexible wrap 201 and can be attached to the flexible wrap 201 using, for example, an appropriate adhesive, stitching, or other mechanism of choice.

The characters that comprise the plurality of alphanumeric characters can comprise a uniform color or a plurality of colors can be used to differentiate amongst the characters if desired. Generally speaking, the color or colors that constitute the alphanumeric characters should visually contrast with the color of the flexible wrap 201 so that the plurality of alphanumeric characters 203 are more readily discernible to an observing mariner using ordinary vision.

Referring to FIG. 1 and FIG. 6, at block 102 this process 100 provides for disposing the flexible wrap 201 around a piling 601 such that the flexible wrap 201 is at least partially disposed above a corresponding water line and with the plurality of alphanumeric characters 203 being disposed outwardly of the piling 601. For many application settings it will be beneficial if the entirety of the flexible wrap 201 is disposed above that water line.

Referring to block 103 of this process 100, the affixment mechanism 202 is now employed to secure the flexible wrap 201 in the installed disposition around the piling 601. More specifically, in this illustrative example, one edge of the flexible wrap 201 overlaps the opposing edge of the flexible wrap 201 to thereby permit engagement of the hooks and loops of the affixment mechanism 202. So configured and disposed, the flexible wrap 201 is now secured by friction in the above-described disposition.

Figure 7:
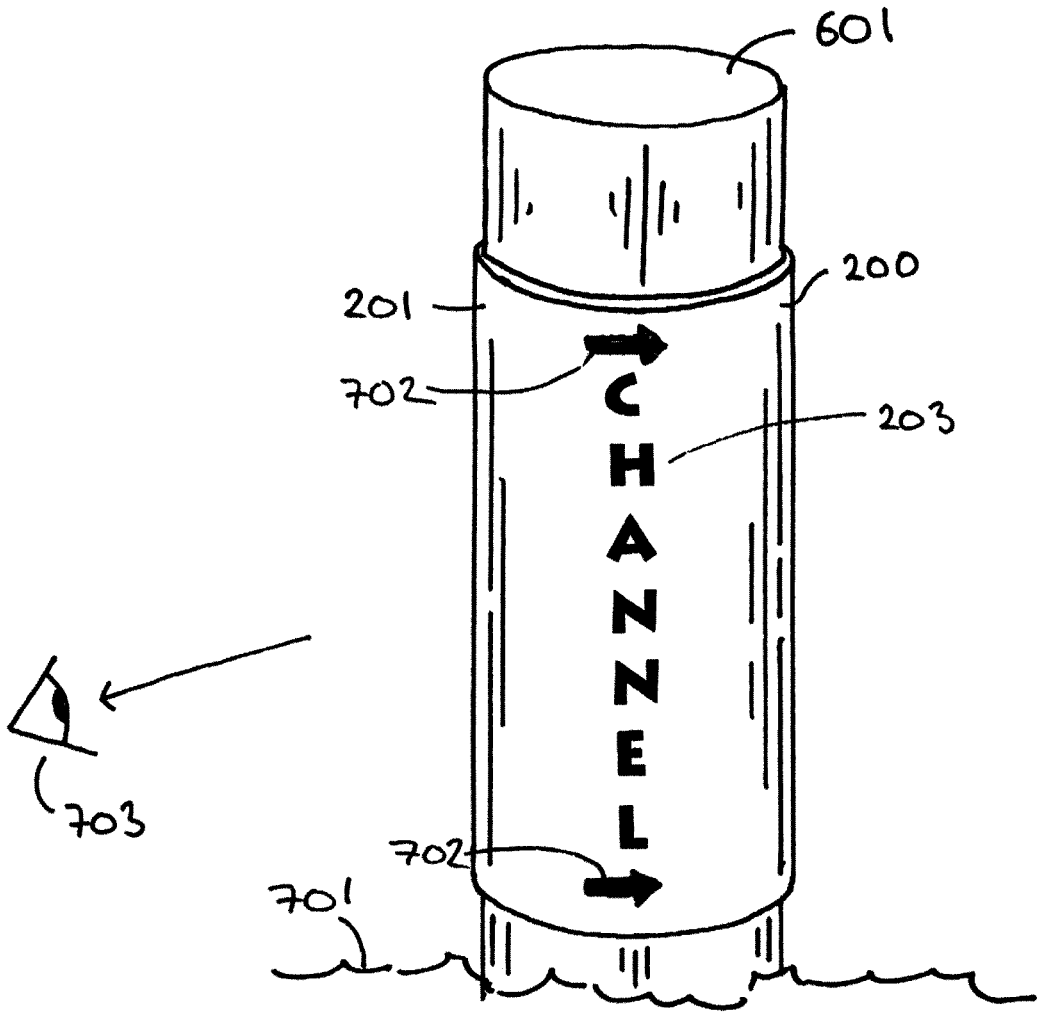
FIG. 7 comprises a perspective view as configured in accordance with various embodiments of the invention.

FIG. 7 presents an illustrative example of a properly installed marine navigational aid 200 per these teachings. In this particular example the entirety of the marine navigational aid 200 is disposed above the waterline 701 that corresponds to this piling 601. In this example the plurality of alphanumeric characters 203 spell the word "channel." In this example, two non-alphanumeric characters are also provided. In particular, an arrow 702 is provided both above and below the plurality of alphanumeric characters 203. These non-alphanumeric characters can be formed of the same material as the alphanumeric characters and can be secured to the flexible wrap 201 in the same manner.

So configured, the informational content conveyed by the plurality of alphanumeric characters 203 (along with any non-alphanumeric characters that may be provided) is ordinarily visible to an observing mariner 703 using ordinary vision (where "ordinary vision" will be understood to mean either uncorrected 20-20 vision or vision corrected with prescription lenses to 20-20).

The described marine navigational aid 200 can be manufactured relatively inexpensively and easily installed by a relatively untrained person. Once installed in a typical marine application setting the marine navigational aid 200 should remain as disposed for any number of seasons while maintaining both an attractive and useful appearance. Although this marine navigational aid 200 does not provide much environmental or impact protection for the piling 601 itself (or for a boat that might impact the aid 201), this apparatus provides inexpensive, clearly discernible and useful navigational information that can greatly increase the ease and accuracy of navigating a boat.

Those skilled in the art will recognize that a wide variety of modifications, alterations, and combinations can be made with respect to the above described embodiments without departing from the scope of the invention. For example, if desired, the flexible wrap 201 can include a second plurality of alphanumeric characters disposed on an opposing side of the flexible wrap 201 (when the flexible wrap is in the above-described installed disposition around the piling). This second plurality of alphanumeric characters can also impart navigational aid content, which content may be identical to or different from the marine navigational aid content imparted by the first-described plurality of alphanumeric characters 203. Accordingly, such modifications, alterations, and combinations are to be viewed as being within the ambit of the inventive concept.

What is claimed is:

1. A marine navigational aid for use with a piling, the marine navigational aid comprising:

a flexible wrap configured to be substantially conformally wrapped around a circumference of the piling without forming a waterproof seal, the flexible wrap at least substantially comprising a non-padded wrap formed of waterproof material;

at least one affixment mechanism coupled to the flexible wrap and configured to affix the flexible wrap in an installed disposition around the piling at least partly above a corresponding waterline such that at least part of the flexible wrap is ordinarily visible to an observing mariner using ordinary vision; and a plurality of alphanumeric characters disposed on an exterior side of the flexible wrap when the flexible wrap is in the installed disposition around the piling, the alphanumeric characters imparting marine navigational aid content to the observing mariner.

2. The marine navigational aid of claim 1 wherein the flexible wrap further comprises a substantially non-resilient flexible wrap.

3. The marine navigational aid of claim 1 wherein the waterproof material comprises an acrylic-based fiber.

4. The marine navigational aid of claim 1 wherein the flexible wrap has a height of at least eighteen inches.

5. The marine navigational aid of claim 1 wherein the at least one affixment mechanism comprises a hooks-and-loops fastener.

6. The marine navigational aid of claim 1 wherein the flexible wrap is sized so as to snugly overlap upon itself when in the installed disposition around the piling.

7. The marine navigational aid of claim 1 wherein the flexible wrap has a rectangular shape when fully opened.

8. The marine navigational aid of claim 1 wherein the flexible wrap comprises a single-ply fabric layer.

9. The marine navigational aid of claim 8 wherein the flexible wrap comprises a single-ply fabric layer having a perimeter hem of at least 1.5 inches.

10. The marine navigational aid of claim 1 wherein the plurality of alphanumeric characters are vertically disposed on the flexible wrap.

11. The marine navigational aid of claim 1 wherein the plurality of alphanumeric characters are formed of a same material as the flexible wrap.

12. The marine navigational aid of claim 1 wherein the plurality of alphanumeric characters are attached to the flexible wrap by stitching.

13. The marine navigational aid of claim 1 wherein the plurality of alphanumeric characters comprise a uniform color that visually contrasts with a color of the flexible wrap such that the plurality of alphanumeric characters are more readily discernable to the observing mariner using ordinary vision.

14. The marine navigational aid of claim 1 further comprising a second plurality of alphanumeric characters disposed on the exterior side of the flexible wrap when the flexible wrap is in the installed disposition around the piling, the second plurality of alphanumeric characters also imparting marine navigational aid content.

15. The marine navigational aid of claim 14 wherein the marine navigational aid content imparted by the second plurality of alphanumeric characters is identical to the marine navigational aid content imparted by the plurality of alphanumeric characters.

16. The marine navigational aid of claim 14 wherein the marine navigational aid content imparted by the second plurality of alphanumeric characters is different from the marine navigational aid content imparted by the plurality of alphanumeric characters.

17. The marine navigational aid of claim 1 wherein the marine navigational aid is non-buoyant.

18. A method for providing a marine navigational aid on a piling, the method comprising:

providing a marine navigational aid comprising:

a flexible wrap configured to be substantially conformally wrapped around a circumference of the piling without forming a waterproof seal, the flexible wrap at least substantially comprising a non-padded wrap formed of waterproof material;

at least one affixment mechanism coupled to the flexible wrap and configured to affix the flexible wrap in an installed disposition around the piling at least partly above a corresponding waterline such that at least part of the flexible wrap is ordinarily visible to an observing mariner using ordinary vision; and a plurality of alphanumeric characters disposed on an exterior side of the flexible wrap when the flexible wrap is in the installed disposition around the piling, the alphanumeric characters imparting marine navigational aid content to the observing mariner;

disposing the flexible wrap around the piling at least partially above a corresponding waterline with the plurality of alphanumeric characters disposed outwardly of the piling;

employing the at least one affixment mechanism to secure the flexible wrap in the installed disposition around the piling without forming a waterproof seal.

* * * * *